US008210509B2

(12) United States Patent
Saitta

(10) Patent No.: US 8,210,509 B2
(45) Date of Patent: Jul. 3, 2012

(54) TILE RETAINING ARTICLE

(76) Inventor: Laura Saitta, Alpharetta, GA (US)

( * ) Notice: Subject to any disclaimer, the term of this patent is extended or adjusted under 35 U.S.C. 154(b) by 800 days.

(21) Appl. No.: 12/327,409

(22) Filed: Dec. 3, 2008

(65) Prior Publication Data

US 2009/0206536 A1 Aug. 20, 2009

Related U.S. Application Data

(60) Provisional application No. 60/992,088, filed on Dec. 3, 2007.

(51) Int. Cl.
*B25B 5/16* (2006.01)

(52) U.S. Cl. ..... 269/164; 269/3; 269/6; 269/166

(58) Field of Classification Search ..... 269/43, 269/71, 75, 95, 143, 164, 166, 240, 254 R, 269/287
See application file for complete search history.

(56) References Cited

U.S. PATENT DOCUMENTS 4,089,428 A 5/1978 Zlaikha
4,398,440 A 8/1983 Epstein
4,653,371 A 3/1987 Vancalbergh
4,693,156 A 9/1987 Olvera
5,148,907 A 9/1992 Tokiwa
5,163,663 A 11/1992 Harris
5,176,058 A 1/1993 Skelly
5,190,271 A 3/1993 Otterbein, II
5,353,910 A 10/1994 Harris et al.
5,387,287 A * 2/1995 Reiter et al. ..... 118/503
5,509,336 A 4/1996 Biagiotti
5,832,913 A 11/1998 Arends
5,975,511 A * 11/1999 Bohler ..... 269/43
6,508,244 B2 1/2003 Lee
7,017,894 B1 * 3/2006 Lin ..... 269/6
7,127,976 B1 10/2006 Fitzsimmons
7,207,251 B2 4/2007 Ushiwata et al.
2006/0043660 A1 * 3/2006 Ping ..... 269/6
2006/0049566 A1 * 3/2006 Bernstein ..... 269/43

* cited by examiner

*Primary Examiner* — Lee D Wilson

(57) ABSTRACT

A tile retaining device that secures a tile or other work piece for cutting is disclosed. The tile retaining device can be used in combination with a circular saw, a wet saw, a band saw, or any other type of mechanical cutting or manipulating device. The tile retaining device secures a tile and provides additional surface area for a user to grasp during the cutting process, which can aid in manually manipulating the work piece through a mechanical cutting or manipulating device. The tile retaining device can also provide cutting guides, and can be adaptable to a variety of shapes and sizes of tiles.

15 Claims, 15 Drawing Sheets

TILE RETAINING ARTICLE

PRIORITY

This application claims the benefit of U.S. Provisional Patent Application Ser. No. 60/992,088, entitled "TILE RETAINING ARTICLE," filed Dec. 3, 2007, the content of which is herein incorporated by reference in its entirety.

FIELD OF THE INVENTION

The technology disclosed herein is generally related to construction, more specifically to tile installation.

BACKGROUND

Tile is commonly used to cover various surfaces, including floors, walls, ceilings, table tops, and many other surfaces, and can be constructed from various materials including stone, ceramic, glass, clay, and metal, among other materials. In some situations, it can be convenient to cut one or more tiles. For example, depending on the size of the tiles relative to the surface on which they will be used, it can be desirable to cut one or more tiles for the purpose of matching the size of the collective tiles with the surface area being covered. In another example, it can be desirable to cut one or more tiles for the aesthetic reasons.

There are a variety of tools that can be used to cut tiles. For example, a wet saw is frequently used to cut certain types of tiles. The tiles are manually positioned proximate to the wet saw and guided through the saw blade. In positioning or manipulating the tile, a person's hands can get uncomfortably close to the blade, which can make the process more difficult or dangerous than would be appreciated. In addition, it is often very difficult to hold small tiles. Some tiles are less than an inch square, and such tiles are very challenging to hold while being cut. It can be hazardous to hold such tiles during cutting, because fingers and hands can be injured. Therefore, a need exists for an improved way to hold tiles during cutting processes.

SUMMARY OF THE INVENTION

The technology disclosed herein is a tile retaining device that secures a tile or other work piece for cutting. The tile retaining device can be used in combination with a circular saw, a wet saw, a band saw, or any other type of mechanical cutting or manipulating device. The tile retaining device secures a tile and provides additional surface area for a user to grasp during the cutting process, which can aid in manually manipulating the work piece through a mechanical cutting or manipulating device. The tile retaining device can also provide cutting guides, and can be adaptable to a variety of shapes and sizes of tiles.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope of the present invention is defined by the appended claims and their legal equivalents.

DRAWINGS

The invention may be more completely understood in connection with the following drawings, in which.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION

Figure 1A:
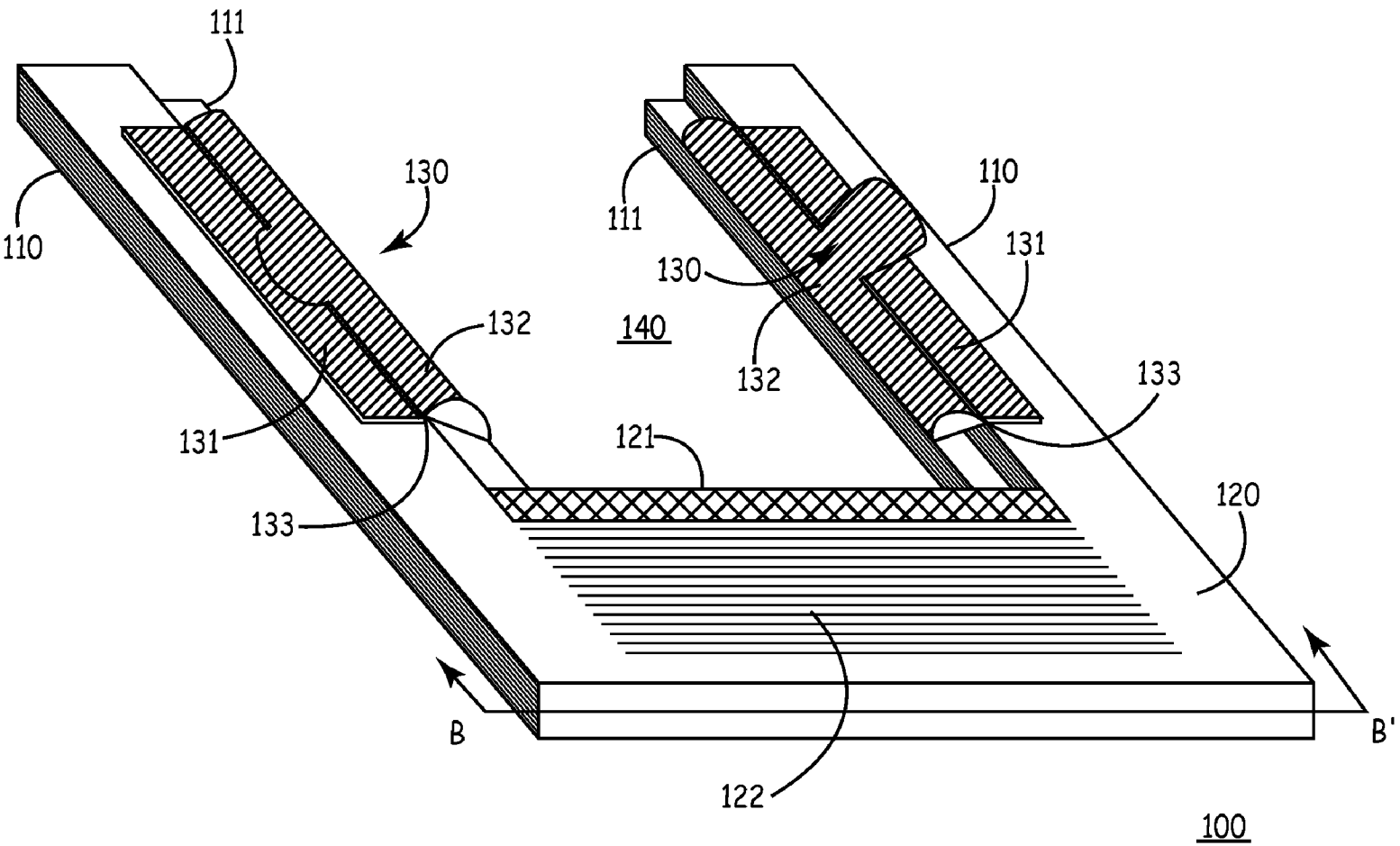
FIG. 1A is perspective view of a tile retaining device constructed and arranged in accordance with an implementation of the invention.

FIG. 1A is perspective view of a tile retaining device constructed and arranged in accordance with an implementation of the invention. Arms 110 having ledges 111 extend from a base 120, which defines an opening 140 configured to at least partially receive a tile. Clips 130 are disposed along the each arm 110. A grip 122 is partially disposed along a surface of the base 120 and a guard 121 is disposed along the inside of the base 120.

The base 120 can be constructed from a variety of materials. In some embodiments, the base 120 in constructed of a substantially rigid material. In one embodiment, the base 120 is constructed from a plastic such as polyvinyl chloride (PVC) or a high molecular weight polyethylene; in another embodiment, the base 120 is constructed from an aluminum alloy or steel, for example. The base 120 can have grips 122 at least partially disposed on the top surface of the base 120. The grips 122 can be designed to increase friction between the hands or fingers of a user and the base 120. The grips 122 could be rubber or latex, for example, or can be ridges formed on the surface of the base 120 itself. The base 120 can also have a guard 121 at least partially disposed on a surface of the base 120. The guard 121 can be constructed of almost any material, but in many embodiments will be a harder material than the base 120, and be situated so that when a blade progresses through the opening 140, it will encounter the guard 121 before contact is made with the base 120.

In the depicted embodiment the arms 110 comprise a first arm 110 and an additional arm 120 that extend from the base 120. The arms 110 can be constructed of any type of material discussed above that would be appropriate for construction of the base 120. The arms 110 can be constructed of a substantially similar material as the base 120 or different material. The arms 110 in many embodiments will be constructed of substantially similar material as the base 120, but this is not necessary for the realization of technology disclosed herein. The arms 110 are generally configured to engage a tile. In this embodiment, each arm 110 has a ledge 111 and a clip 130 that are configured to engage a tile there between.

The ledges 111 can be constructed of substantially similar material as that of the arms 110 or different material. Materials that generally would be appropriate from which to construct the arms 110 would also be appropriate for the construction of the ledges 111. In at least one embodiment the ledges 111 are formed by removing material from the arms 110 with a machining tool such as a mill. In multiple embodiments, the ledges 111 result from a mold that defines the ledges 111. Such a mold could additionally define the arms 110 and the base 120 in one or more embodiments.

The clips 130 are configured to releasably secure a tile against the ledges 111. When secured, a tile is prevented from substantially translating relative to the tile retaining device 100. In the embodiment shown, the clips 130 comprise two components 131, 132 that meet at a joint 133 that allows pivoting motion of the components relative to each other. A spring or a similar component can be used to provide tension in the joint 133 between the first component 131 and the second component 132. The first component 131 has at least one substantially planar surface that can be mounted on an arm 110 with, for example, an adhesive, epoxy resin, or the like or, in another embodiment, with screws, staples, or the like. The second component 132 has a tab for a user to releasably secure a tile, and a bottom surface that can be substantially planar to substantially increase surface area contact with a tile, which can increase frictional forces exerted by the bottom surface onto the surface of a tile.

In at least one embodiment, a relatively higher-friction material can be dispersed on surfaces to increase the frictional forces exerted on a tile, such as rubber, latex, or any other material that can realize similar benefits. When the tab is depressed, the second component 132 separates from the ledge 111, defining an opening that is available to receive the tile. When the tab is released, the second component 132 secures the tile against the ledge.

In another embodiment, an alternative clips (not shown) are used that are pivotally mounted on the arms 110. The clips can comprise at least one substantially flat bottom surface to rotate across at least a portion of an arm 110, to partially extend into the opening 140 and to secure one or more portions of the surface of a tile against the ledge by applying a slight compressive force. Such an embodiment can include a plurality of such clips disposed along the top surface of the arms 110, although this is not necessary in practicing the technology disclosed herein.

Figure 1B:
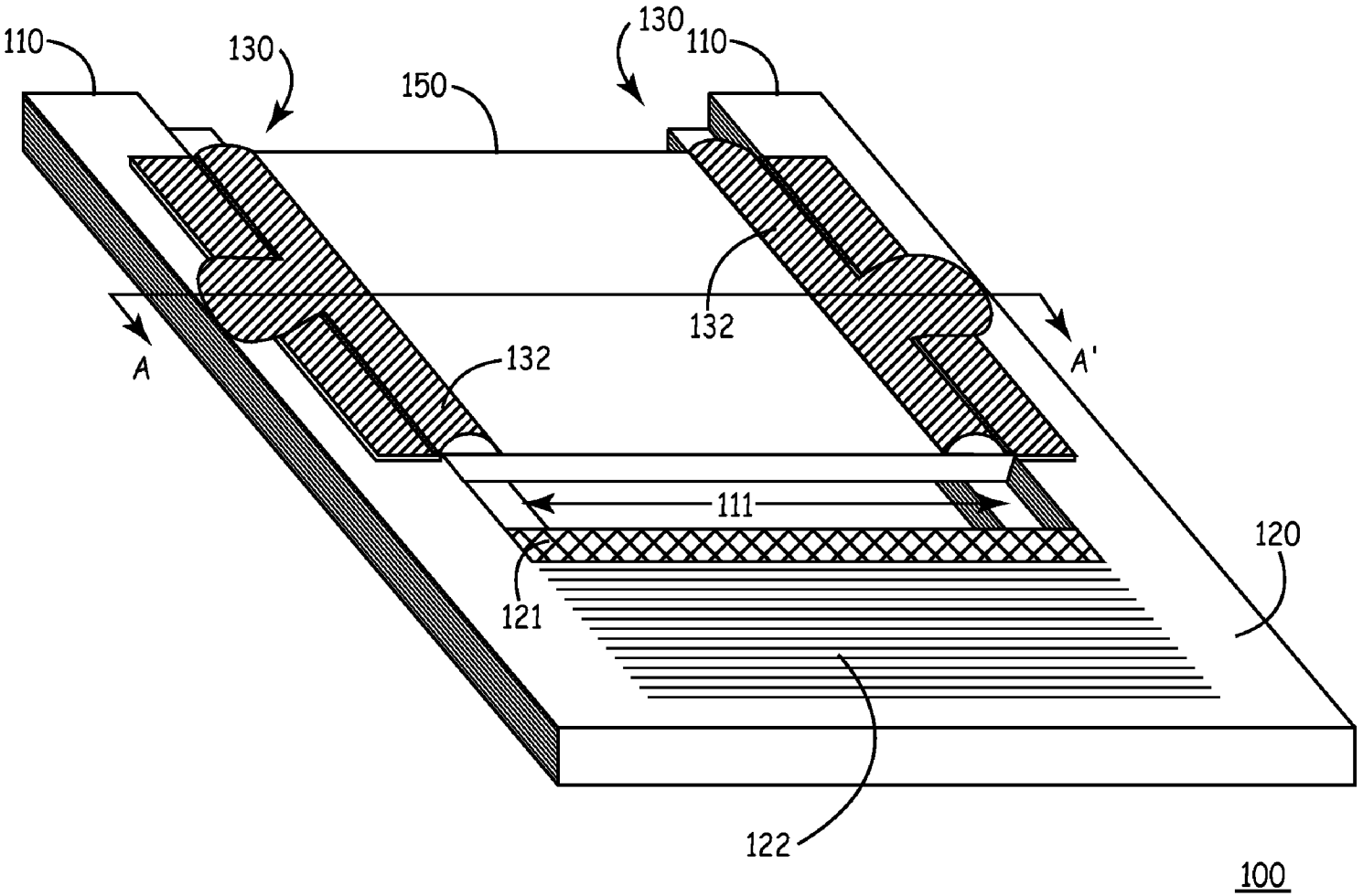
FIG. 1B is a perspective view of a tile retaining device constructed and arranged in accordance with an implementation of the invention, showing a tile held within the tile retaining device.

FIG. 1B is a perspective view of a tile retaining device constructed and arranged in accordance with an implementation of the invention, showing a tile held within the tile retaining device. Each clip 130 and proximate, corresponding ledge 111 engages one end of the tile 150.

It is generally understood that increasing the surface area of the tile that is in contact with either the ledge 111 or the second component 132 of the clip 130 increases the frictional forces exerted on the tile 150 to prevent translation of the tile 150 relative to the tile retaining device 100. It is also generally understood that at least the portion of the tile 150 to be cut should be exposed. In some embodiments the ledges 111 can make contact with 5% to 90% of the surface area of the bottom of the tile 150. In other embodiments the ledges 111 can make contact with 5% to 50% of the surface area of the bottom of the tile 150. In some embodiments the second component 132 of the clip 130 makes contact with 2% to 10% of the surface are of the top of the tile. In one or more of those embodiments the second component 132 of the clip 130 makes contact with 1% to 20% of the surface area at the top of the tile. In one or more of those embodiments the second component 132 of the clip 130 makes contact with 5% to 90% of the surface area at the top of the tile.

Figure 1C:
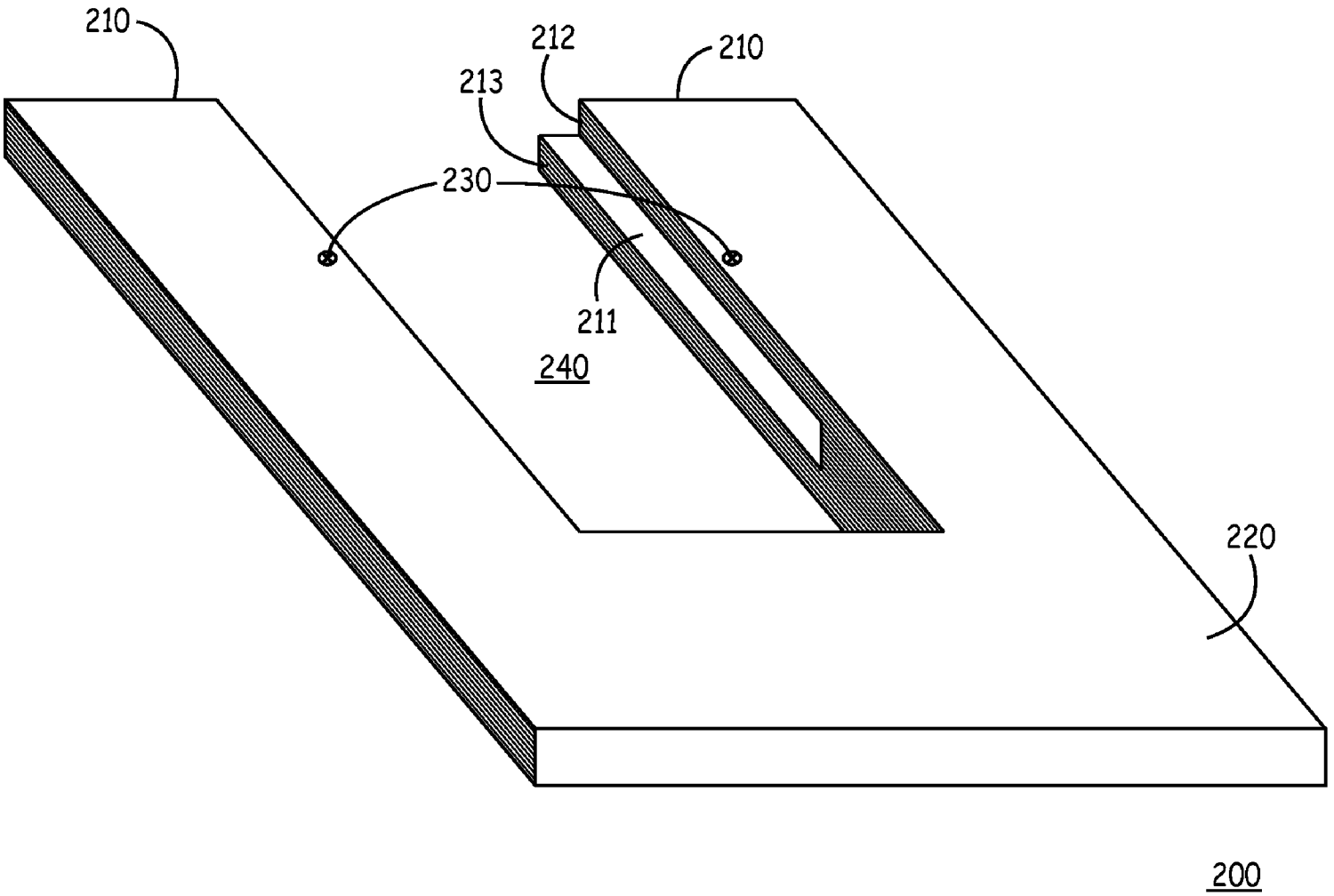
FIG. 1C is perspective view of a tile retaining device consistent with at least one embodiment of the invention.

FIG. 1C is perspective view of a tile retaining device consistent with at least one embodiment of the invention. There is a first arm and an additional arm 210 extending from a base 220, which defines an opening 240 that is configured to at least partially receive a tile. Each arm 210 defines a channel 211 therein that is configured to at least partially receive a tile. Screws 230 are disposed along each of the arms 210.

The channels 211 are configured to receive at least a portion of a tile. The channels 211 can be configured to exert frictional forces on at least a portion of the surface area of a tile. The channels 211 can be created through removing material of the arms with a machining tool such as a mill, for example, or in another embodiment can be created through the use of a mold. In various embodiments, the mold can define the arms 210, channels 211 and the base 220. Each channel 211 can be configured to receive at least one edge of a tile. In such embodiments a tile can be inserted into the channels 211 at the distal end of the arms 210, and slid down the channels 211 until at least one channel 211 ends. In various embodiments at least a portion of the perimeter of the channels 211 can be coated with a material such as rubber or latex to increase frictional forces exerted on the surface of a tile by the arms. In another embodiment a felt or other type of fabric is at least partially disposed on the perimeter of the channels 211.

Screws 230 disposed along the arms 210 can be configured to substantially secure a tile to prevent substantial translation of the tile relative to the tile retaining device 200. The screws 230 can comprise virtually any material known in the art. One or more holes can be drilled along the arm to accommodate such screws 230. In some embodiments the screws 230 are situated so that when a tile is inserted in the channels 211, the screws 230 are manually screwed in by a user so as to secure the tile.

In at least one embodiment the screws 230 extend through the top layer of the arm 212, through the channel 211, to (or through at least a portion of) the bottom layer of the arm 213 to provide structural support to at least one edge of the tile to prevent translation of the tile across the channel. In at least another embodiment, the screws extend through the top layer of the arm 212 up to the tile within the channel 211 and exert a frictional force directly on the tile itself. In another embodiment, the screws 230 extend through the top layer of the arm 212, through the channel 211, and through at least a portion of the bottom layer of the arm 213 to exert a compression force on the top layer of the arm 212 and bottom layer of the arm 213, which can increase the frictional force of the arm 210 on the tile.

In some embodiments multiple methods of using screws can be used, such as screws in combination with a wing nut, for example, to apply compression forces to the arms 210. In some embodiments no screws are used. In some embodiments a clamp could be used instead of screws 230 to achieve similar results as just described. In at least one other embodiment a latch is used to engage the channels 211 to prevent translation of a tile. The latch can be disengaged before insertion of the tile, and then engaged after insertion of the tile. The arms 210 can be configured to receive one or more latches for such use. In an additional embodiment a rod is inserted into pre-defined openings in the arms 210 to abut a retained tile and prevent translation of the tile across the arms 210. Also, stoppers can be used that are configured to be received by the channels 211 abutting the distal end of a tile after the tile has been placed in the tile retaining device 200. The stoppers could be rubber or cork, for example. In other embodiments, additional or different means can be used to prevent translation of a tile.

It can be possible for the location of the screw 230 to be translatable relative to the arm. This can be possible in embodiments where one or more screw channel (not shown) is cut into the top layer of the arms 210 that allows linear translation of the screw 230 along the arms 210. In this type of embodiment the screw 230 can be moved to accommodate tiles of various lengths, for example, or also tiles in different positions in the tile retaining device 200, in another example. Multiple holes could be drilled in the arms 210 to accommodate the use of screws in different positions. Rods or latches could also be used in combination with pre-drilled holes or a channel to accommodate tiles of various sizes.

Figure 2A:
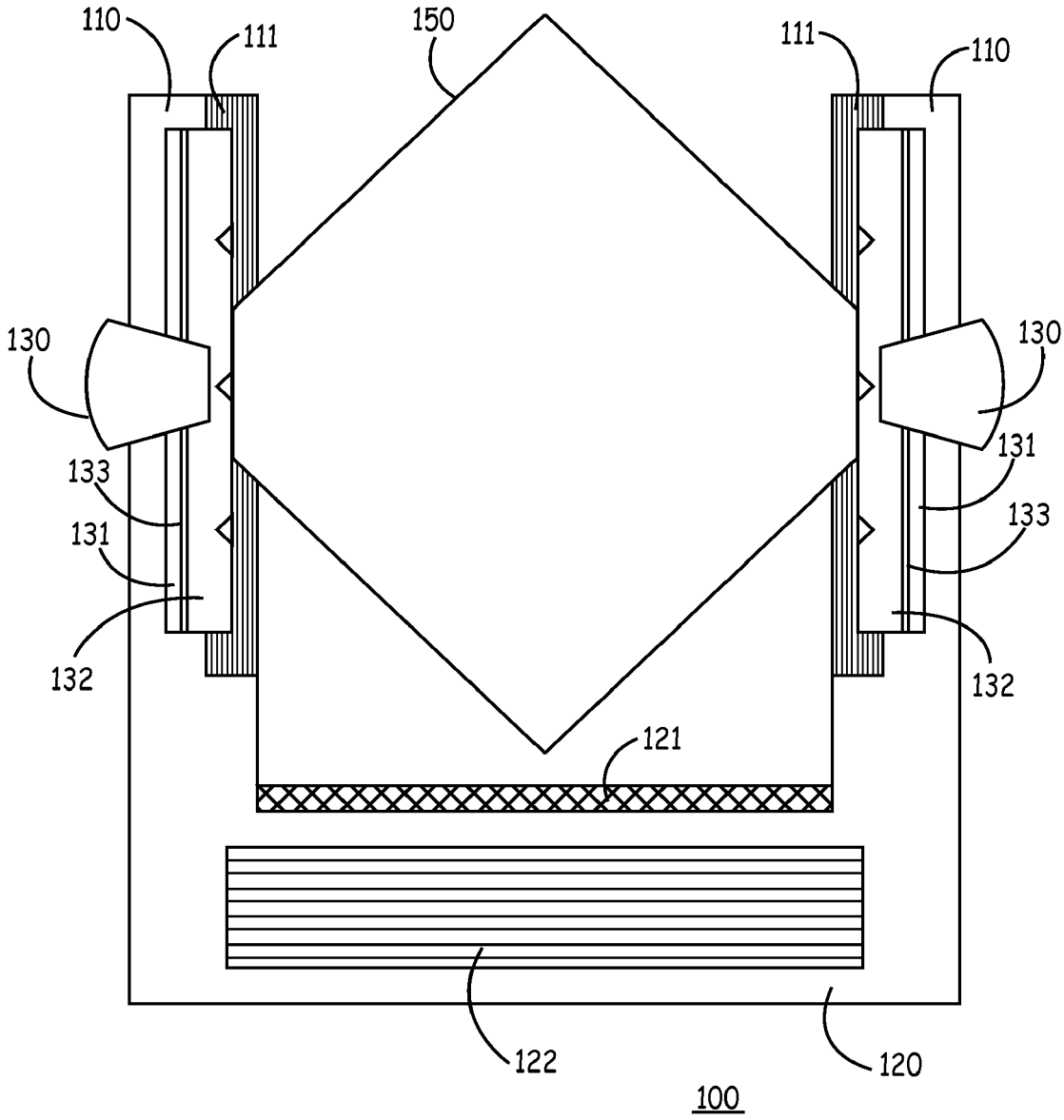
FIG. 2A is a top plan view of a tile retaining device in accordance with at least the embodiment of the invention shown in FIG. 1B.

FIG. 2A is a top plan view of a tile retaining device in accordance with at least the embodiment of the invention shown in FIG. 1B. This embodiment can be consistent with the embodiment of the invention depicted in FIGS. 1A and 1B. Two opposite corners of the tile 150 are secured by the tile retaining device 100. This use of the tile retaining device 100 can be appropriate when preparing to make a diagonal cut along the tile 150. In order to accommodate the tile 150 when placed on the tile retaining device 100 in preparation for a diagonal cut, the ledges 111 can extend under the first component 131 of the clip 130, to allow for the length of the diagonal of the tile 150. Such embodiments are described in more detail in the discussions of 5A, 5B, and 5C, below.

Figure 2B:
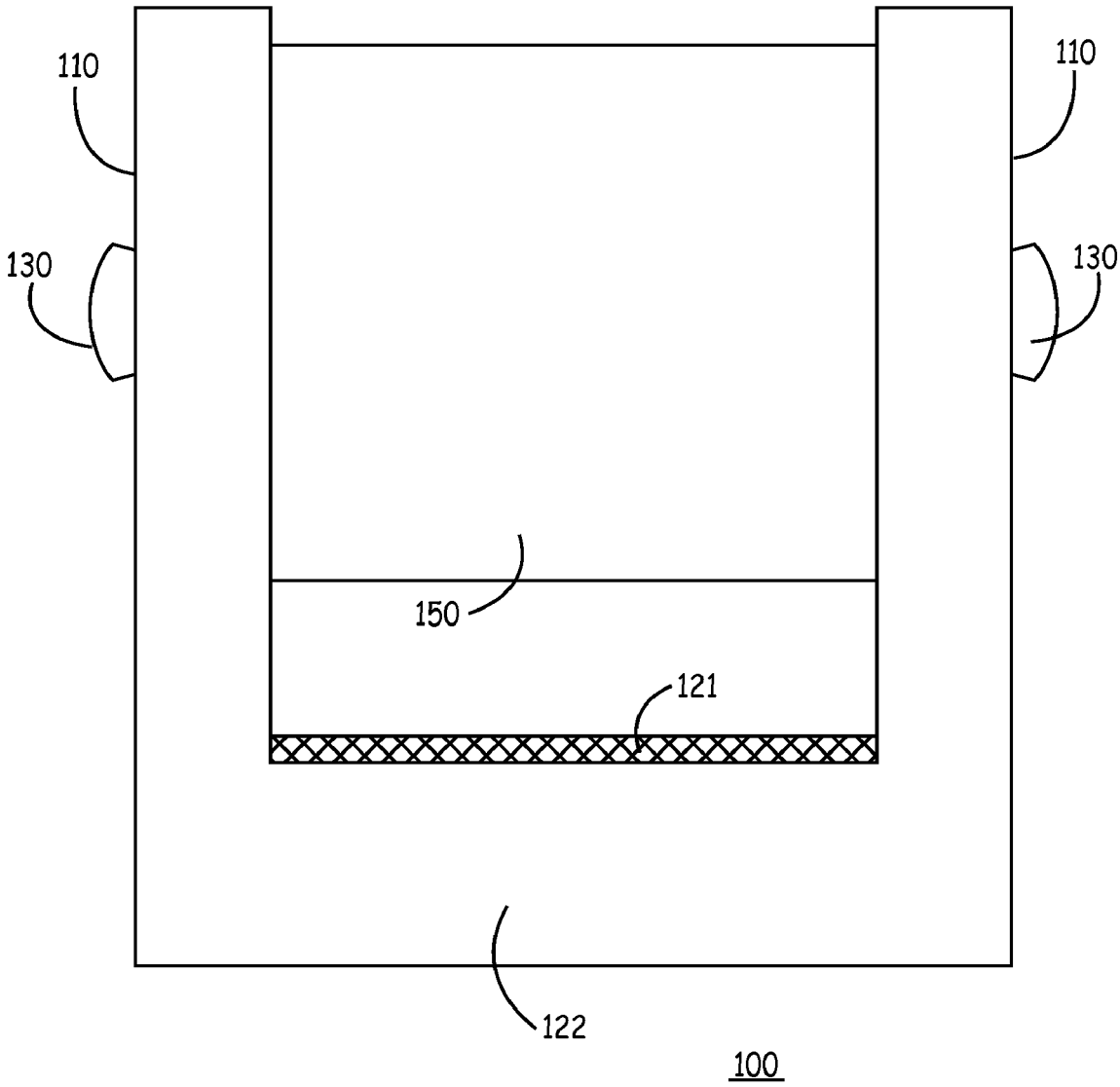
FIG. 2B is a bottom plan view of a tile retaining device in accordance with at least the embodiment of the invention shown in FIG. 1B.

FIG. 2B is a bottom plan view of a tile retaining device in accordance with at least the embodiment of the invention shown in FIG. 1B. The bottom of the tile retaining device 100 can be substantially planar so as to provide predictable and substantially straight cutting of the tile 150 when, for example, the tile retaining device 100 is set on a platform for a mechanical cutting or manipulating device.

Figure 3A:
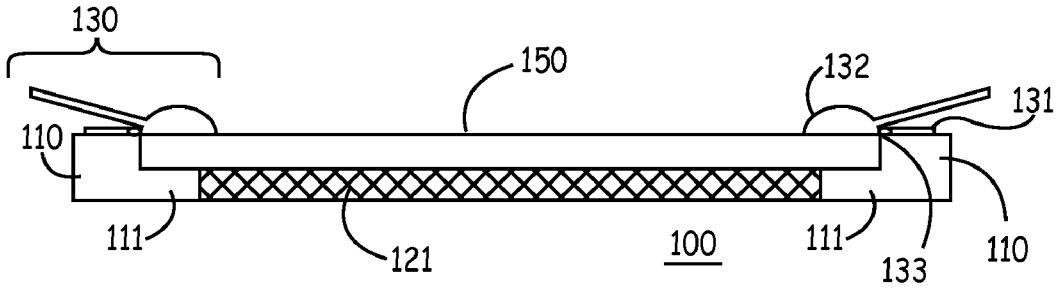
FIG. 3A is a first end view of a tile retaining device in accordance with at least the embodiment of the invention shown in FIG. 1B.
Figure 3B:
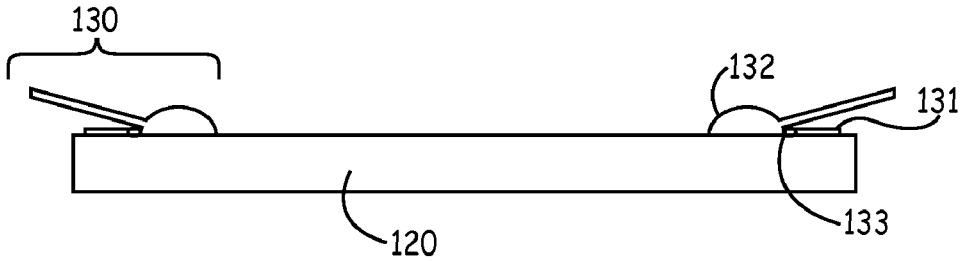
FIG. 3B is a second end view of a tile retaining device in accordance with at least the embodiment of the invention shown in FIG. 1B.
Figure 3C:
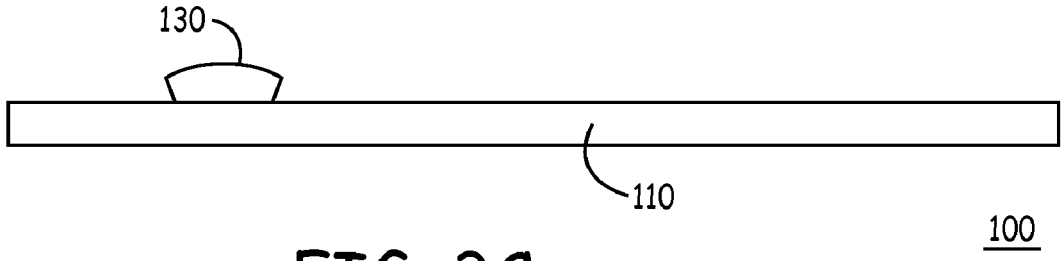
FIG. 3C is a first side view of a tile retaining device in accordance with at least the embodiment of the invention shown in FIG. 1B.
Figure 3D:
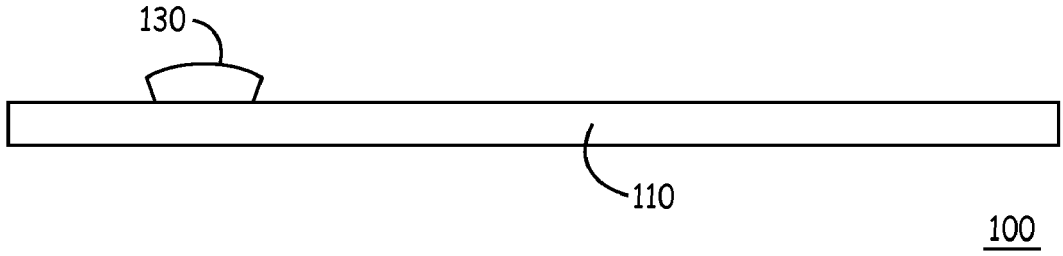
FIG. 3D is a second side view of a tile retaining device in accordance with at least the embodiment of the invention shown in FIG. 1B.

FIG. 3A is a first end view of a tile retaining device in accordance with at least the embodiment of the invention shown in FIG. 1B. The tile 150 is held in place on two sides between the two ledges 111 each extending from the arms 110 and the two clips 130 disposed along the arms 110. Behind the tile 150 is the guard 121 that is disposed on the proximal end of the base 120 (not shown). FIG. 3B is a second end view of a tile retaining device in accordance with at least the embodiment of the invention as shown in FIG. 1B. From this view the base 120 and the clips 130 are visible. FIGS. 3C and 3D are both side views of a tile retaining device in accordance with at least the embodiment of the invention shown in FIG. 1B. In both of these views an arm 110 and tab of the clip 130 is visible.

Figure 4A:
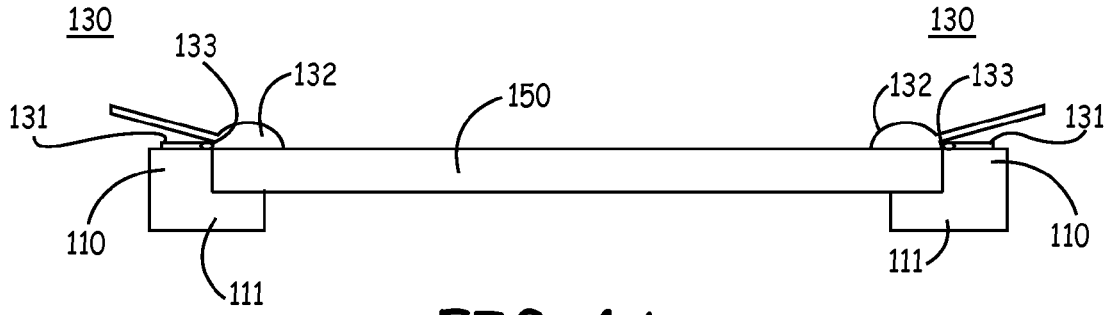
FIG. 4A is a first cross section of a support arm from an example embodiment, taken along lines A-A' of FIG. 1B.

FIG. 4A is a first cross section of a support arm from an example embodiment, taken along lines A-A' of FIG. 1B. The ledges 111 extend from the arms 110 and provide support for the tile 150 from the bottom. The first components 131 of the clips 130 are coupled to the arms 110 while the second components 132 of the clips 130 can provide a compression force on the tile 150 resulting from tension in the joint 133 of the clip 130

Figure 4B:
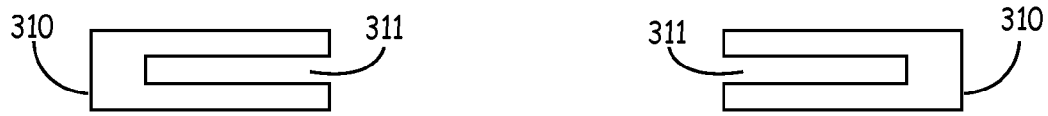
FIG. 4B is a second cross section of a support arm from an example embodiment consistent with at least one embodiment of the invention.

FIG. 4B is a second cross section of arms from an example embodiment consistent with at least one embodiment of the invention. Each arm 310 defines a channel 311 that is configured to at least partially receive a tile. The surface area of the material surrounding the channel 311 can have material disposed thereon to increase the frictional force on the tile and/or enable insertion of the tile through the channel 311. Such material can include felt cloth, rubber, latex, or any other material that can offer such benefits.

Figure 4C:
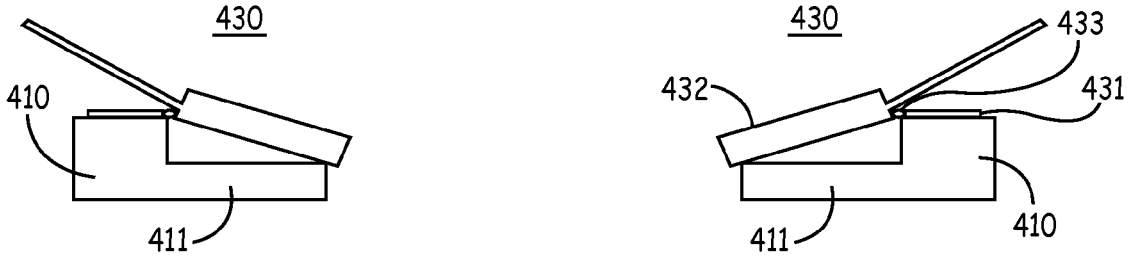
FIG. 4C is a third cross section of a support arm from an example embodiment consistent with at least one embodiment of the invention.

FIG. 4C is a third cross section of arms from an example embodiment consistent with at least one embodiment of the invention. In this embodiment the clips 430 have a longer profile than those previously shown in FIG. 4A, for example, and can potentially increase the frictional forces exerted on a tile because of increased contact between the clip and the surface area of the tile. Additionally, the ledge has a longer profile as compared to those previously shown, such as in the example depicted in FIG. 4A, which can also increase the surface area in contact with the tile and, as a result, potentially increase frictional forces exerted on the tile.

Figure 4D:
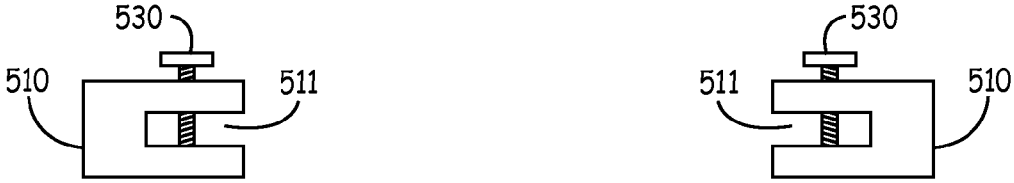
FIG. 4D is a fourth cross section of a support arm from an example embodiment consistent with at least one embodiment of the invention.

FIG. 4D is a fourth cross section of arms from an example embodiment consistent with at least one embodiment of the invention. Similar to the example depicted in FIG. 4B, each arm 510 defines a channel 511 that is configured to at least partially receive a tile. Screws 530 are located in the arms and can be used to prevent translation of the tile relative to the tile retaining device. In one embodiment the tile is inserted into the channel into a position, and the screws 530 are inserted abutting one or more ends of the tile, as necessary to prevent relative translation of the tile with regard to the tile retaining device. "Ends" refers to two sides of the tile, the first end being the side of the tile closest to the base, and the second end of the tile being the distal side. In some embodiments screws 530 can abut both ends of the tile. Screws and similar devices can also be used as described above in the explanation of FIG. 1C.

Figure 5A:
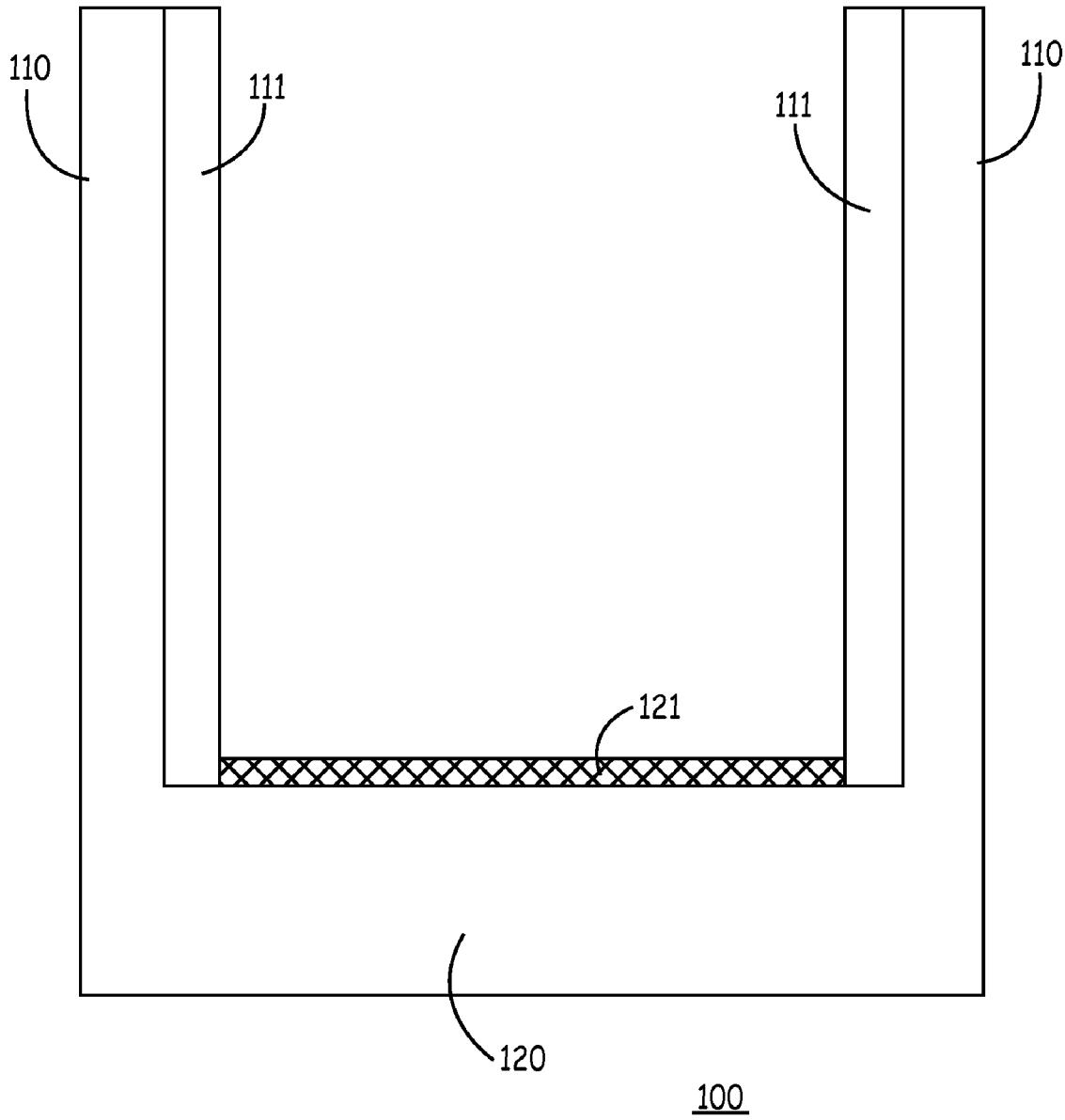
FIG. 5A is a planar cross section of a first embodiment of the invention, taken along lines B-B' of FIG. 1A.

FIG. 5A is a planar cross section of a first embodiment of the invention, taken along lines B-B' of FIG. 1A, slightly above a plane concurrent with the ledges 111. The tile retaining device 100 and the ledges 111, specifically, are configured to at least accommodate a tile having a width X. Generally the tile can be a square, each side having width X, but it is also within the scope of the technology disclosed herein that the tile can be rectangular having width X. It can be possible for the tile to have a width less than X, in some embodiments. The profiles of the ledges 111 extend to the base in this embodiment, although this is not necessary for realization of the technology disclosed herein. In many embodiments the ledges 111 can extend partially down the arms 110. In embodiments where a channel (not shown) is used to engage a tile, the channels can have a similar profile to the ledges 111 shown in FIG. 5A.

Figure 5B:
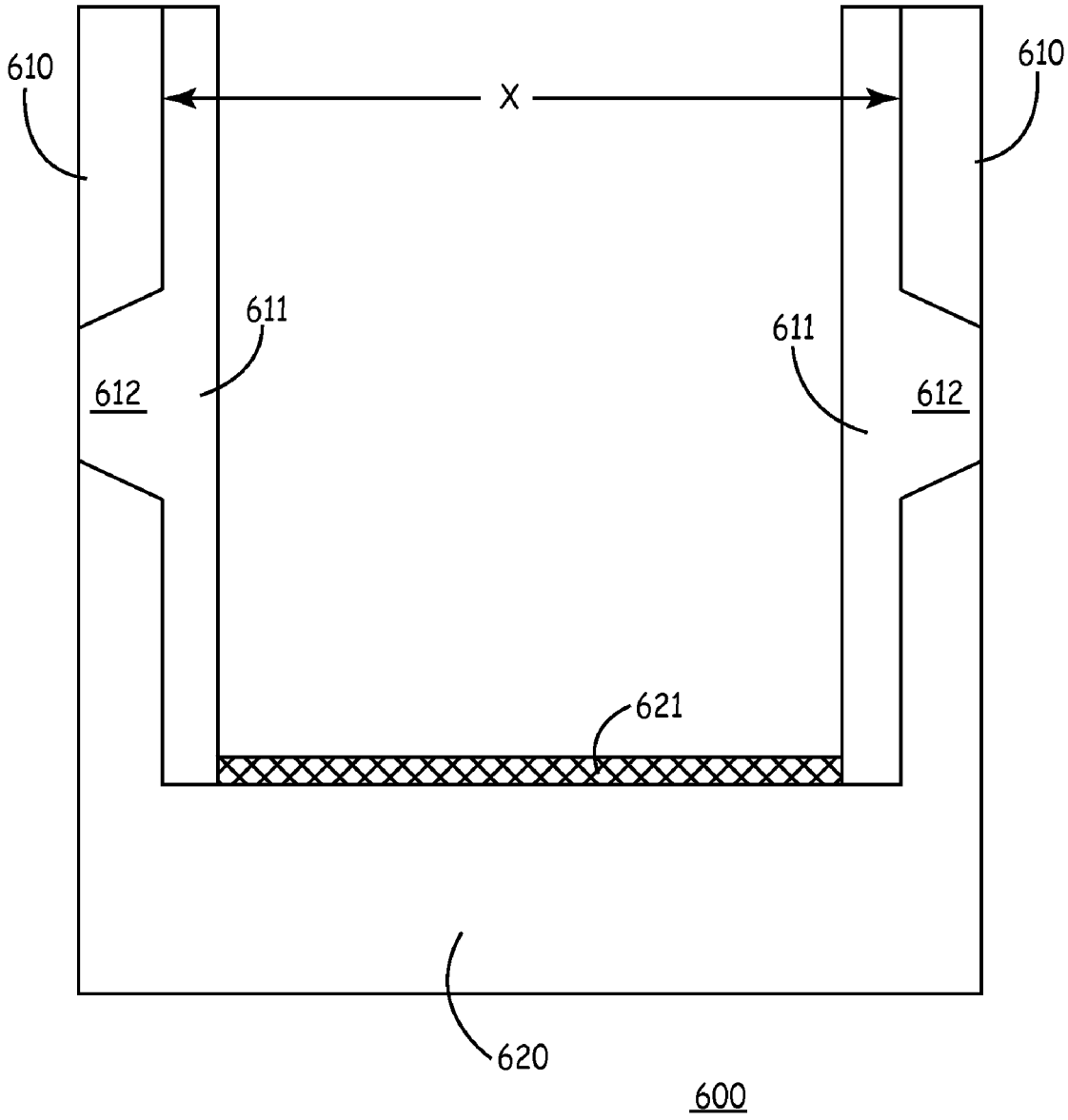
FIG. 5B is a planar cross section of an additional embodiment of the invention.

FIG. 5B is a planar cross section of an additional embodiment of the invention. The tile retaining device 600 and the ledges, specifically, are configured to at least accommodate a tile having a width X, including a square tile having a width X, positioned in the tile retaining device 600 at an angle in preparation to make a diagonal cut, similar to the tile position depicted in FIG. 2A. In use, the tile can be progressed down the ledges 611 into position for cutting, etc., or, the tile can be progressed down the ledges 611 and turned so that the corners fit into ledge extensions 612.

Figure 5C:
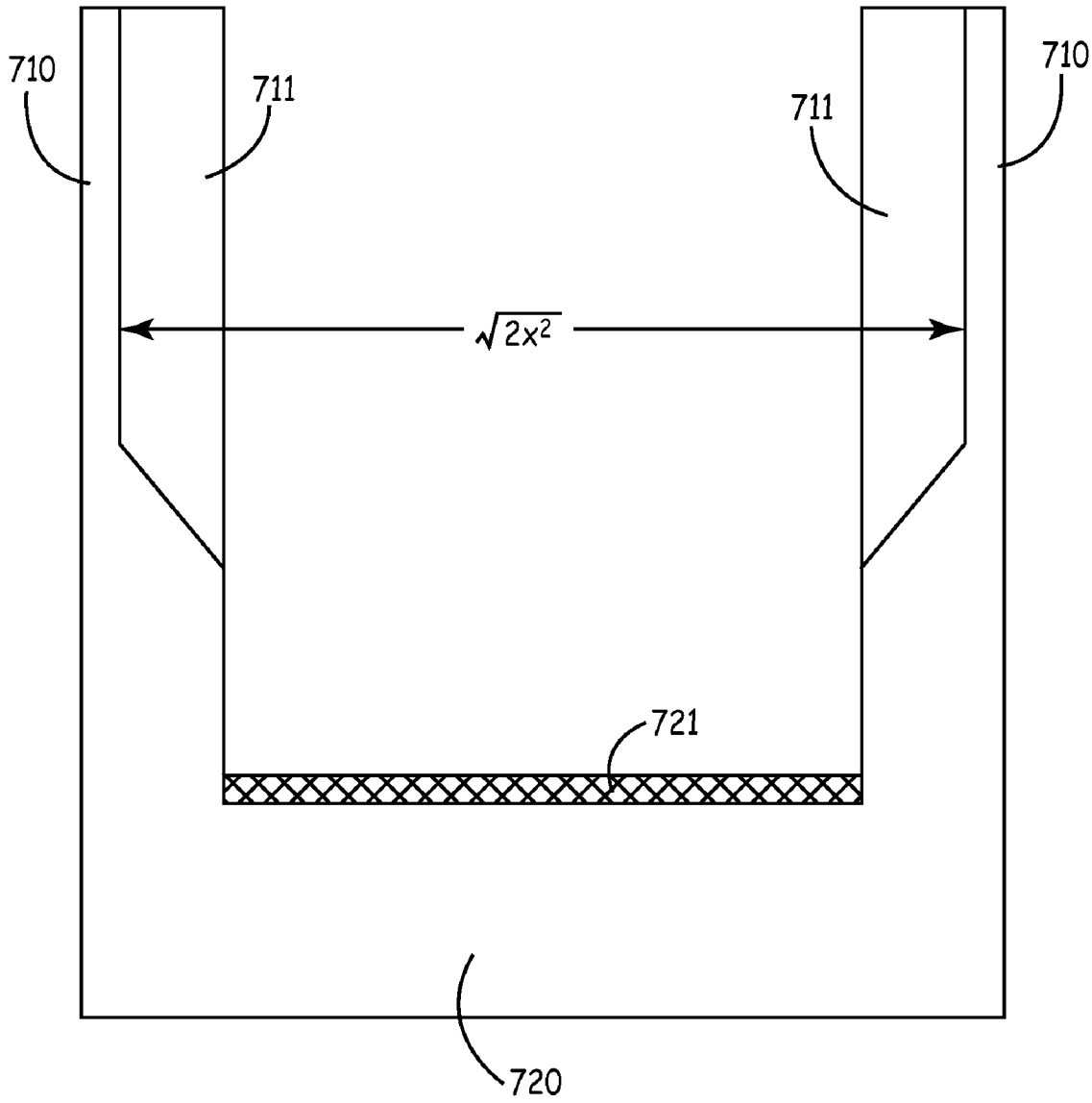
FIG. 5C is a planar cross section of an additional embodiment of the invention.

FIG. 5C is a planar cross section of an additional embodiment of the invention. In this embodiment the ledges 711 (or channels) are configured so that a tile having width X, can be received by tile retaining device 600 with the corners inserted in the ledges 711, progressed down the arms 710 toward the base 720, and positioned for a diagonal cut, similar to the position of the tile depicted in FIG. 2A.

Figure 6A:
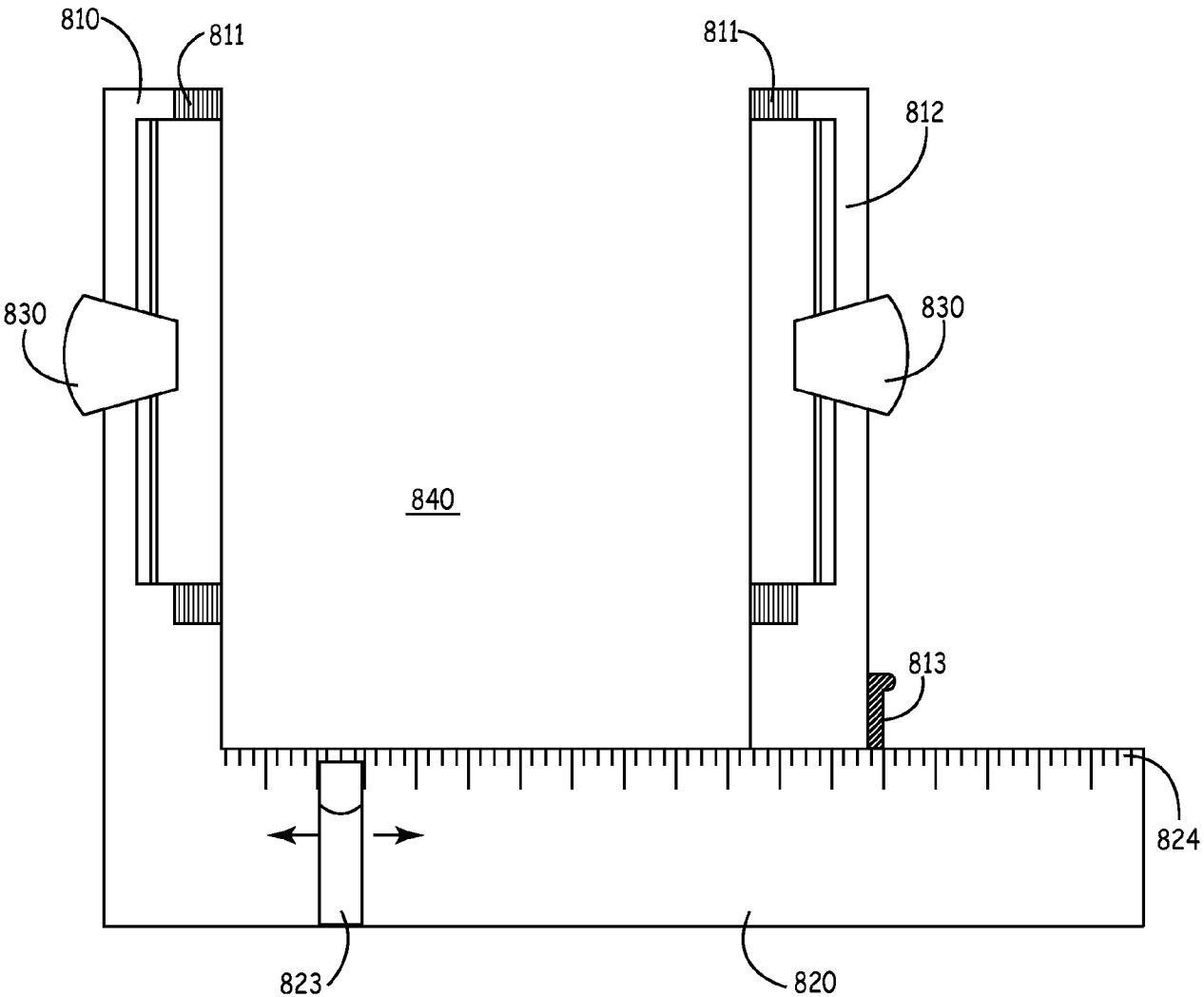
FIG. 6A is a top plan view of a tile retaining device constructed and arranged in accordance with an alternative embodiment of the invention

In some embodiments the tile retaining device can be configurable to accommodate a wide range of tile sizes. FIG. 6A is a top plan view of a tile retaining device constructed and arranged in accordance with such an embodiment of the invention. A base 820 is coupled to a first arm 810 and second arm 812. The first arm 810 and second arm 812 have ledges 811 and clips 830 as a means of securing at least a portion of a tile (although other means of securing tile, as described above, can be used). At least one arm 812 is slidably disposed along one side of the base 820, so as to accommodate tiles of a wide variety of widths. A latch 813 can be coupled to the second arm 812 and be used to fasten the second arm 812 in a particular position. The base 820 can have a ruler 824 and a cutting guide 823 disposed thereon.

The latch 813 that can be used to fasten the second arm in a particular position along the base 820 can be a spring latch, for example, that engages teeth (not shown), or the like, disposed along the length of the base 820. A user can withdraw the latch 813, position the second arm 812 at a proper point along the base 820, and then advance the latch 813, which engages teeth disposed along at least a portion of the base 820. When the latch 813 is a spring latch, withdrawing the latch 813 can comprise a user lifting the latch 813 and advancing the latch 813 can comprise the user letting go of the latch 813. The latch 813 can engage teeth by advancing between teeth, for example, which disallows relative movement of the latch 813 across teeth, and therefore disallows movement of the second arm 812 across the base 820. In some embodiments, the base 820 can be configured to have a track (not shown) that allows the second arm 812 to be slidably disposed across the base above the teeth, although this is not necessary for realization of the technology disclosed herein.

Other types of latches can also be used that are known in the art. In some embodiments, a latch 813 and tooth combination is not used at all, such as in an example embodiment where is draw latch is used to secure the second arm 812 to the base 820. In such an example embodiment one side of the draw latch is anchored to the second arm 812, and slidably disposed along at least one surface of the base 820. In other embodiments a latch is not used to secure the second arm 812 in one position on the base 820. In such embodiments the second arm 812 can be secured with screws and pre-drilled holes or slots, clamps, clips, or the like.

The ruler 824 can be disposed along the edge of the base to provide guidance in adapting the tile retaining device 800 for use with particular-sized tiles. The ruler 824 can be an adhesive-coated print that is applied to the base 820, for example or, in another example, a ruler can be carved, stamped, or painted onto the base 824. Any other method known in the art to provide a ruler on the base 824 of the tile retaining device 800 can also be used. In some embodiments, instead of a ruler, lengths along the base 820 can be designated to correspond to particular tile sizes. Such designations can be applied to the base through any method known in the art, including carving, painting, applying an adhesive-coated print, or the like.

A guide 823 can be slidably disposed along one side of the base 820. The guide 823 can provide guidance with regard to a location to make a cut on a tile. The guide 823 can be a battery powered laser pointer that projects light on the tile itself. In another example, the guide 823 can be a rod or grid to provide an ocular reference point to a user. In some embodiments the guide 823 will not be slidably disposed but, rather, fixed at a specific position on the tile retaining device 800. In another embodiment, the guide 823 is extendable to one or more points in the opening 840 to provide guidance or a reference point.

Figure 6B:
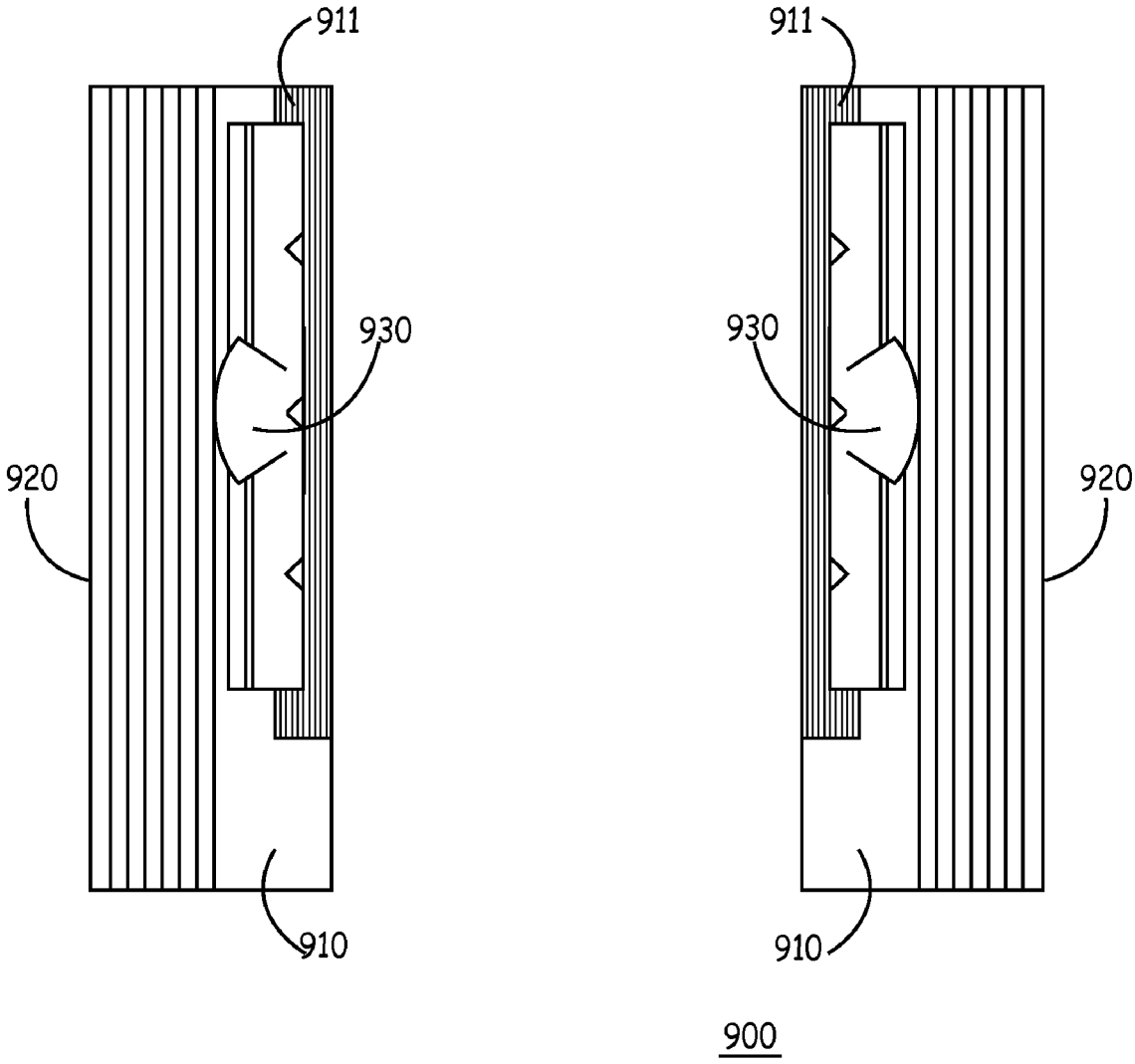
FIG. 6B is a top plan view of a tile retaining device constructed and arranged in accordance with an alternative embodiment of the invention.

FIG. 6B is a top plan view of a tile retaining device constructed and arranged in accordance with an alternative embodiment of the invention. In this embodiment the arms 910 are distinct components that are not coupled to each other or a base. In this embodiment it is possible that grips 920 can be disposed along each arm. Such grips 920 can be similar to the grips used in combination with a base as described in the discussion of FIG. 1A, above. While in the example shown ledges 911 and clips 930 are used to engage a tile, in other embodiments other methods of securing a tile can be used, as described above.

Figure 7A:
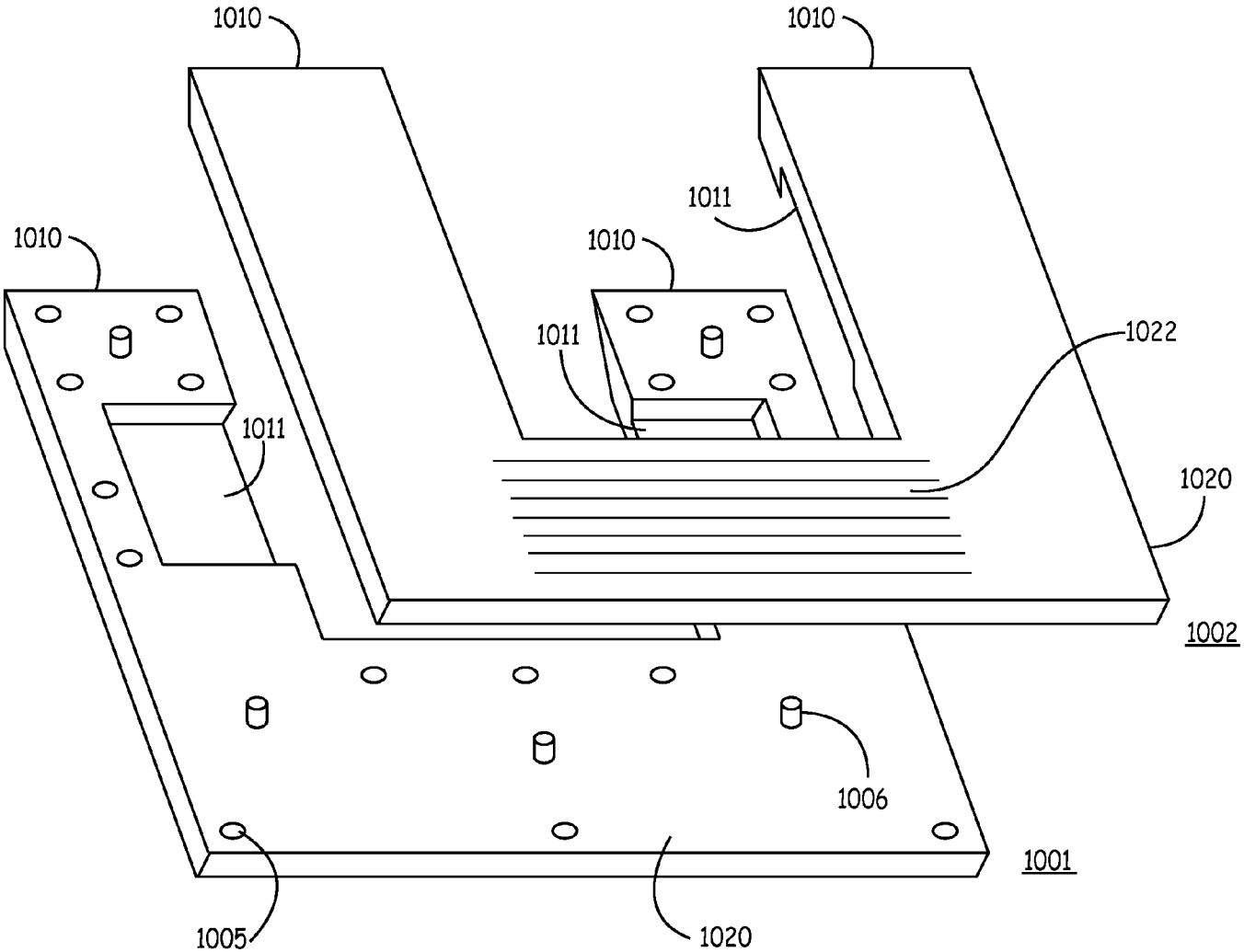
FIG. 7A is a perspective view of an additional embodiment of a tile retaining device consistent with at least one embodiment of the invention.

FIG. 7A is a perspective view of an additional embodiment of a tile retaining device consistent with at least one embodiment of the invention. A bottom frame 1001 is designed to receive a top frame 1002 through the use of female 1005 and male 1006 components, in one embodiment. The arms 1010 define ledges 1011 that are collectively configured to receive a tile. In use a tile can be placed in the ledges 1011 defined by the bottom frame 1001, and the top frame 1002 can engage the bottom frame 1001 to "sandwich" the tile. In some embodiments, when coupled, the top frame 1002 and bottom frame 1001 exert a compression force on the tile, although this is not necessary for practice of the technology disclosed herein.

In one embodiment the ledges 1011 are configured to substantially receive one particular size of tile in one position. In another embodiment, the ledges 1011 are configured to receive one particular size of tile in multiple positions, such as in preparation for a cut parallel to a diagonal of a tile and also in preparation for a cut parallel to a side of the tile. In at least one embodiment the ledges 1011 are configured to receive two or more particular tile sizes. As shown, the bottom frame 1001 and the top frame 1002 partially define ledges 1011 configured to receive a tile. In some embodiments, the ledges can be substantially defined by either the bottom frame 1001 or the top frame 1002. In one embodiment the bottom frame 1001 can define a left ledge and the top frame 1002 can define a right ledge, or vice versa.

In one embodiment, the female components 1005 and male components 1006 are designed to provide a snap-fit between the bottom frame 1001 and the top frame 1002. In other embodiments, there is not a snap-fit between the bottom frame 1001 and the top frame 1002. In some embodiments female components 1005 and male components 1006 are not used and, rather, clips, clamps, screws, or other methods of coupling the bottom frame 1001 and the top frame 1002 are used. Such other coupling methods can also be used in conjunction with the female components 1005 and male components 1006.

Figure 7B:
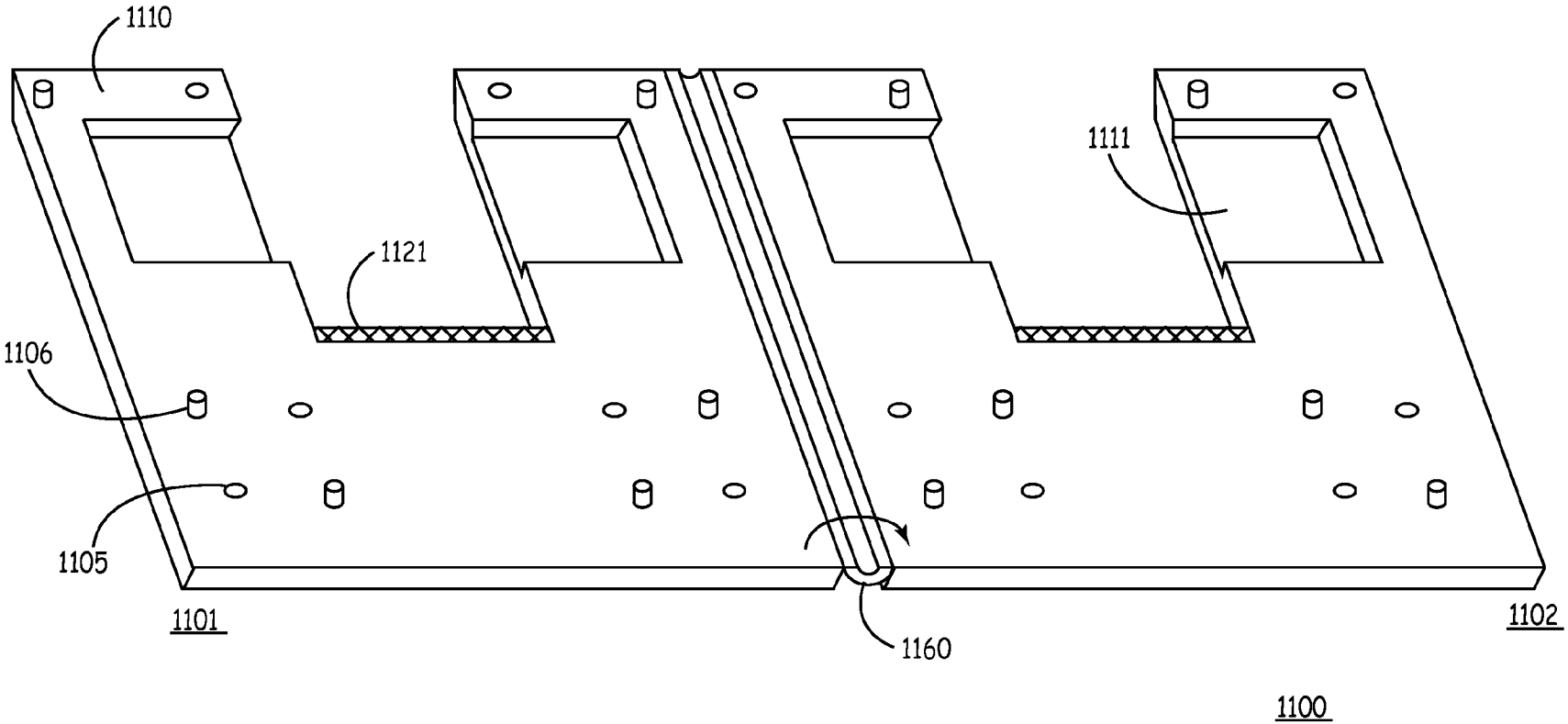
FIG. 7B is a perspective view of an additional embodiment of a tile retaining device consistent with at least one embodiment of the invention.

FIG. 7B is a perspective view of an additional embodiment of a tile retaining device consistent with at least one embodiment of the invention. In this embodiment, the bottom frame 1102 is joined to the top frame 1101 through a hinge 1160. The bottom frame 1102 and the top frame 1101 each define a ledge 1111 that, collectively, are configured to receive a tile. Female components 1105 and male components 1106 can be distributed on the matching surfaces of the bottom frame 1102 and the top frame 1101 to enable coupling.

The hinge 1160 can comprise any material known in the art for making hinges. In one embodiment the hinge 1160 comprises the same material as the bottom frame 1102 and the top frame 1101, such as when the frames 1102, 1101 comprise a plastic, for example. In such an embodiment the plastic can be a relatively thinner as compared to the frames 1102, 1101 to enable flexibility. In other embodiments the hinge 1160 is distinct from the bottom frame 1102 and the top frame 1101 and is coupled to each frame 1102, 1101 with an adhesive, epoxy resin, screws, or the like. In such embodiments the hinge 1160 can comprise metal, for example and can be constructed through means known in the art.

As mentioned above, other means of coupling the bottom frame 1102 and the top frame 1101 can be used in conjunction with or in replacement of the female components 1105 and male components 1106. As also mentioned above, the ledges 1111 that are defined by the top frame 1101 and the bottom frame 1102 need not be substantially similar, although the ledges 1111 can be in some embodiments. The ledges need be configured to receive at least one tile in one position.

Figure 7C:
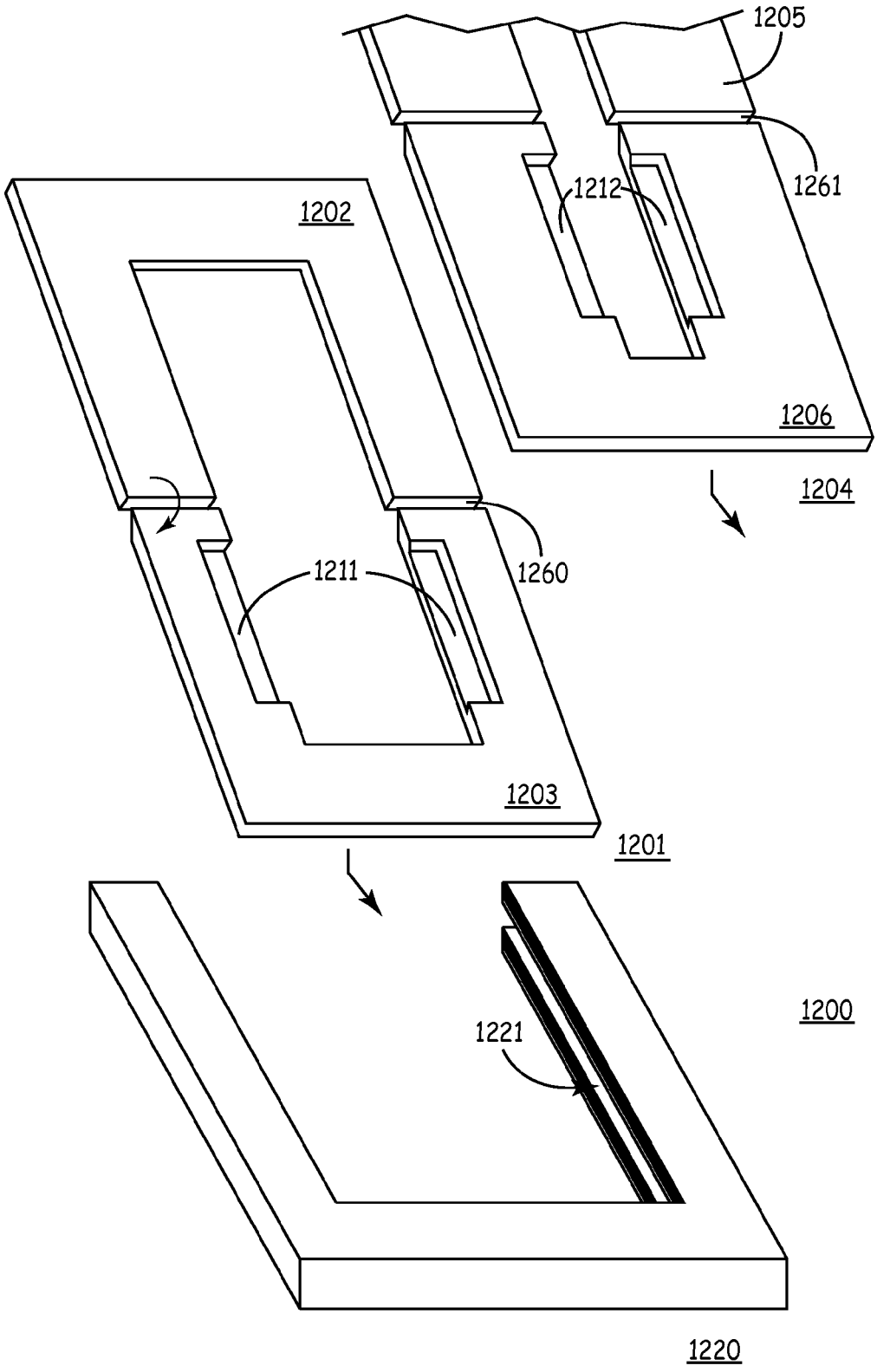
FIG. 7C is a perspective view of an additional embodiment of a tile retaining device consistent with at least one embodiment of the invention.

FIG. 7C is a perspective view of an additional embodiment of a tile retaining device consistent with at least one embodiment of the invention. A frame 1220 is configured to receive a first tile retainer 1201 and a second tile retainer 1204. The frame 1220 can comprise any material that is suitable for constructing the base and arms (not shown) of a tile retaining device described in the description of FIG. 1A, above. The first tile retainer 1201 defines a first opening 1211 configured to receive a first-sized tile, and the second tile retainer 1204 defines an second opening 1212 configured to receive a second-sized tile. In operation, a first tile is placed in the first 1211 opening configured to receive the first-sized tile; and a top frame 1202 is folded via a hinge 1260 over the tile to substantially make contact with a bottom frame 1203. The first tile retainer 1201 is then inserted into slots 1221 defined by the frame 1220 that are designed to receive the first tile retainer 1201 and the second tile retainer 1204.

When a second tile size need be cut or manipulated, a second tile retainer 1204 can be used that defines a second opening 1212 configured to receive second-sized tiles. Similar to use of the first tile retainer 1201, the second-sized tile is placed in the second opening 1212 defined by the second tile retainer 1204. The top frame 1205 is folded over the bottom frame 1206 to "sandwich" the second-sized tile. The second tile retainer 1204 can then be received by the slots 1221 defined by the frame 1220 in preparation for tile cutting or manipulation.

In the embodiment shown the frame 1220 can exert sufficient compression force on the first tile retainer 1201 and second tile retainer 1204 to prevent translation of the tile relative to the tile retaining device 1200. In the embodiment shown the frame 1220 can exert sufficient compression force on the first tile retainer 1201 and second tile retainer 1204 to prevent translation of the first tile retainer 1201 or the second tile retainer 1204 relative to the frame 1220. In some embodiments a securing means can be used to couple the first tile retainer 1201 and the second tile retainer 1204 to the frame 1220 such as clamps, clips, screws, female and male components, or the like.

For realization of the technology disclosed herein the top frames 1202, 1205 and the bottom frames 1203, 1206 need not be joined through hinges 1260, 1261. In some embodiments the top frames 1202, 1205 and bottom frames 1203, 1206 can be discrete components as shown in a previous embodiment. In some embodiments a hinge can join the sides of the arms of the tile retainer rather than the front of the arms.

I claim:

1. An apparatus for securing a tile for cutting, the apparatus comprising:

a base member;

a first arm extending substantially perpendicular from the base member, the first arm having a ledge extending from the base along substantially the length of the first arm wherein said first arm having a component spaced above said ledge forming a slot inbetween and including actuation member to move said component by increasing and decreasing said space slot;

a second arm extending substantially perpendicular from the base member, the second arm having a ledge extending from the base along substantially the length of the second arm wherein said second arm having a component spaced above said ledge forming a slot inbetween and including actuation member to move said component by increasing and decreasing said space slot;

an extension of the ledge of the first arm, the extension providing a recess in the first arm for receiving a corner of a tile; and an extension of the ledge of the second arm, the extension providing a recess in the second arm for receiving a corner of a tile;

wherein the first arm and second arm and base member define an open interior space into which a tile may be placed such that two opposed corners of the tile rests within the ledge extensions of the first arm and second arm.

2. The apparatus for securing a tile of claim 1, further comprising a spring mounted clamp for securing a tile.

3. The apparatus for securing a tile of claim 1, further comprising a screw clamp for securing a tile.

4. The apparatus of claim 1, further comprising indicia on said base.

5. The apparatus of claim 4, further comprising said indicia on said base with a slide.

6. An apparatus comprising:

a frame member configured to mechanically engage a tile to prevent substantial translation of the tile during cutting, the frame member comprising:

first and second opposed arms, said first and second opposed arms defining an opening for retaining a tile, and a ledge on each of first and second opposed arms, the ledge configured for securing the opposite edges of a tile wherein said first and second arms having a component spaced above said ledge forming a slot inbetween and including actuation member to move said component by increasing and decreasing said space slot.

7. The apparatus of claim 6, wherein the first and second opposed arms are slidably joined to change the distance between the arms to accommodate tiles of different sizes.

8. The apparatus of claim 6, wherein the ledge is configured and arranged to hold a square tile along either the edge of the tile or at the corner of the tile.

9. The apparatus of claim 6, further comprising a spring loaded clamp on each of the first and second opposed arms to secure the tile to the apparatus.

10. The apparatus of claim 6, further comprising a screw clamp on each of the first and second opposed arms to secure the tile to the apparatus.

11. The apparatus of claim 6, wherein the ledge comprises a portion of a slot, the slot configured to receive a tile.

12. An apparatus comprising:

Base member:

a first frame member configured to include a recess within said first frame member also configured to to reversibly and mechanically engage a tile to prevent substantial translation during cutting; and a second frame member configured to include a recess within said first frame member also configured to reversibly and mechanically engage the tile to prevent substantial translation during cutting wherein said first and second member having a component spaced above a ledge on said first and second frame members forming a slot inbetween and including actuation member to move said component by increasing and decreasing said space slot.

13. The apparatus of claim 12, further comprising a third frame member coupled to the first frame member and second frame member so that the first frame member and second frame member are substantially parallel.

14. The apparatus of claim 13, wherein the second frame member is slidably disposed along the third frame member.

15. The apparatus of claim 12, further comprising a clamp configured to engage a tile.

* * * * *